United States Patent [19]

Sellar

[11] Patent Number: 5,004,166

[45] Date of Patent: Apr. 2, 1991

[54] APPARATUS FOR EMPLOYING DESTRUCTIVE RESONANCE

[76] Inventor: John G. Sellar, 6045 E. Evans Pl., Lakewood, Colo. 80227

[21] Appl. No.: 405,000

[22] Filed: Sep. 8, 1989

[51] Int. Cl.[5] ..... B02C 19/18

[52] U.S. Cl. ..... 241/36; 241/1

[58] Field of Search ..... 241/1, 33, 36, 301

[56] References Cited

U.S. PATENT DOCUMENTS

| | | | |
|---|---|---|---|
| 1,719,257 | 2/1929 | Booth et al. | 241/1 X |
| 3,539,221 | 11/1970 | Gladstone | 241/1 X |
| 3,823,301 | 7/1974 | Swarat | 241/1 X |
| 4,012,870 | 3/1977 | Berniere et al. | 51/165 R |
| 4,276,463 | 6/1981 | Kine | 241/1 X |
| 4,283,956 | 8/1981 | Lechner et al. | 73/799 |
| 4,307,610 | 12/1981 | Leupp | 73/579 |
| 4,389,891 | 6/1983 | Fournier | 73/579 |
| 4,397,823 | 8/1983 | Dimpfl | 241/1 X |
| 4,446,733 | 5/1984 | Okubo | 73/579 |
| 4,539,845 | 9/1985 | Molimar | 73/578 |
| 4,653,697 | 3/1987 | Codina | 241/1 |

OTHER PUBLICATIONS

Disa Elektronik Publ. No. 1206E 55 X Laser Doppler Vibrometer System.

*Primary Examiner*—Timothy V. Eley

*Attorney, Agent, or Firm*—Henderson & Sturm

[57] ABSTRACT

A method and apparatus (10) for fracturing a mass of material (100) using resonant frequencies by initially determining the resonant frequency of the mass of material, using an energy generating unit (12) to impart the determined resonant frequency to the mass of material, monitoring any changes in the resonant frequency caused by fracturing and adjusting the energy generating unit (12) so that it will vary the frequency produced to the new resonant frequency.

4 Claims, 2 Drawing Sheets

APPARATUS FOR EMPLOYING DESTRUCTIVE RESONANCE

TECHNICAL FIELD

The present invention relates generally to the field of resonance measuring and testing, and more particularly to the use of measured resonance as an input to a resonance producing apparatus for destructive purposes.

BACKGROUND ART

As can be seen by reference to the following U.S. Pat. Nos. 4,539,845; 4,283,956; 4,307,610; 4,446,733; and 4,389,891, the prior art is replete with myriad and diverse resonance measuring and testing apparatus.

Molimar, U.S. Pat. No. 4,539,845, describes the mechanical sensing of the natural frequency of an object under fatigue testing, electrically coupling the sensed frequency to a mechanical input device so that the object is kept at resonance but controlling amplitudes to fixed values, thereby reducing the testing time and forces required for fatigue testing compared with the other methods, wherein the amplitude of vibration of the tested object (e.g., engine and motor components) is kept to a predetermined set point value.

Okubo, U.S. Pat. No. 4,446,733, like Molimar, uses a combination of mechanical sensing, electric coupling, and mechanical input to measure and maintain resonance in structural materials for the purposes of stress relieving, fatigue testing and non-destructive load testing.

Fournier, U.S. Pat. No. 4,389,891, in a manner similar to Moilmar and Okubo, also uses a combination of mechanical sensing, electric coupling, and mechanical input to measure the natural frequencies in turbine and compressor vanes and propeller blades.

In addition, Leupp, U.S. Pat. No. 4,307,610, uses a combination of machanical sensing, electric coupling, and mechanical input to maintain resonance in order to measure crack propagation in samples for assessing the fatigue behavior of a material or a component; and Lechner, U.S. Pat. No. 4,283,956 induces resonance to detect and indicate the onset of cracking in articles subjected to dynamic loading.

While all of the aforementioned prior art patents are more than adaquate for the basic purpose and function for which they have been specifically designed, these prior art methods and apparatus are ultimately aimed at preventing fatigue type destruction and have overlooked the fact that even though resonance can be a highly destructive force, that destructiveness can be used for useful purposes.

Resonance is an extremely powerful phenomena. Major man-made structures, designed to be indestructible, have been destroyed by relatively insignificant forces, which by chance have been applied at resonant frequencies. All objects and structures have resonant frequencies, some of which can be sufficiently "damped" to be almost undetectable.

The destructive power of resonance is witness to the well known Army instruction "break step on bridges" and is evidenced by that most famous bridge failure at Tacoma, Wash., captured on film in 1940, wherein a 2,800 foot span of two lane bridge literally "blew down" in a 40 mph wind.

While the body of knowledge on resonance is extremely large, there have been vary few attempts to use the destructive power of resonance for useful work in the mining industry.

The work that has been done appears to have concentrated on the ultrasonic frequency range, i.e., above 20,000 cycles/second, whereas, experimental field data on three rock types indicates that lower frequencies, under 4,000 Hz, are more applicable.

Resonant frequencies are those that a solid body naturally assumes during relaxation from an energized state to an unenergized state. The lowest frequency at which a body freely vibrates is called the primary frequency. Other resonant frequencies are called harmonics. When bodies are excited, deliberately or by accident, at their resonant frequencies, very small forces can display seemingly disproportionate and devastating effects.

The application of energy to excite resonant frequencies is restricted by basic underlying principles. Vibration can be represented by a simple pendulum, such as a ball suspended from a string. To initiate the pendulum motion, the ball is displaced to one side of the quiescent position of the pendulum. Once the ball is released, the most effective phase of the pendulum swing to apply energy to increase amplitude occurs between the release of the ball and the arrival of the ball at the quiescent position. As the ball passes through the quiescent position, the positive force of the ball diminishes to the point where the ball stops and swings back towards the release position wherein the reverse travel of the ball is always active against the initial direction of the swing.

Applying this example to the principles of resonance, it is the amplitude of vibration exceeding the elasticity constant which breaks solid objects. The objective in applying resonance for destruction is therefore to maximize the swing. It can be seen that the most effective time to apply energy to the pendulum is the first one-fourth of one cycle. To maximize amplitude, under no circumstance can the energy pulse be greater than one-half of one cycle. This is the first of two basic principles. Pulse time (t) must be less than $1/2f$ (ideally, $1/4f$) where f = primary frequency, in cycles per second.

Again, using the pendulum, it is apparent that the energy pulse can be applied every swing (cycle) every second swing, or every third swing etc., it cannot be applied twice per swing. This is the second principle. The frequency of the pulse is either f or f divided by an integer. It cannot exceed f.

While these two principles are simple, maintaining their integrity in practice is not. Indications are that the applicable frequency range is between 200 and 5,000 cycles each second. Physically pulsing energy at these high cyclical rates is difficult enough and is compounded by the requirement for absolute accuracy. If the pulse frequency is out by even one cycle per second, then for half of every second the pulses act against resonance.

Unlike the simple sine-wave type motion of a swing, rock present a much more complex phenomena. The apparent resonant frequency of a particular rock may be expected to be effected by at least the following: the mass of the rock, the rock material, the circumstances of the rock (i.e., free standing, partially embedded, etc.), discontinuities—joints and fractures, the point of measurement, and, the point of excitation.

However, provided that: the points of excitation and measurement do not change, the input force frequency exactly matches the measured frequency or the measured frequency divided by an integer, the input force waves are supportive in phase, and the amplitude of vibration does not return to zero between pulses, then the rock will be in resonance.

If the amplitude is increased to the point where the measured resonant fequency is changed, then destructive work has been accomplished. This of course may not break the rock—it may merely have altered the circumstances of a fracture or joint plane. To effectively achieve breakage, not only must the amplitude of the resonant vibration be sufficient, but any change in measured output frequency must immediately be reflected in the input frequency.

DISCLOSURE OF THE INVENTION

Briefly stated, the present invention involves the use of resonance to effectively utilize a destructive power to produce a beneficial result in a mining and/or comminution environment wherein low electrical power outputs are used to produce disproportionate results compared to conventional techniques.

In essence, the present invention comprises a method and apparatus for sensing the resonance of a mass such as rock, or rock particles or the bonding between rock particles and applying a resonant pulse to the same to induce fractures.

In addition, the method of this invention uses resonant frequencies below the ultrasonic frequency of 20,000 cycles per second to accomplish the destructive fracturing of a mass.

As will be explained in greater detail further on, means are used to measure the exact or approximate fundamental resonant frequency or frequencies of solids or solid particles or the bonding between solid particles in their individual circumstances and electronically couple the measured frequency or frequencies divided by an integer, to an input device such as a laser, wherein, the vibration of the mass is sensed by a remote vibration detector whose output is used to determined the change in resonant frequency produced by the partial fracturing of the rock, whereupon, the frequency producing means is varied to the new frequency to continue the fracturing process occuring within the rock mass.

If energy is applied scientifically at resonance, it is reasonable to assume that the energy level required for breaking will be much less than either the laboratory measured crushing energy level or the brutal non-scientific battering delivered by a rock breaker. Looking at these different breaking techniques: crushing, single blow, and resonance; if an energy relationship can be established between crushing and single blow, ane then between single blow and resonance, it should be possible to estimate the relationship between resonance and crushing.

Firstly, scientific laboratory information is available on crushing energy levels and single blow energy levels to achieve rock breakage. By comparing the two, an order of magnitude saving can be estimated between the slow application of energy (crushing) as opposed to the fast application (single blow).

For example:

Crushing: Laboratory tests on Hematite samples show crushing energy levels of 15–30 Joules per kg.

Single blow: Laboratory tests indicate that single blow energy levels required for breakage are approximately 2×weight (tonnes) Joules per kg.

$$\text{Therefore: } \frac{\text{Crushing Energy}}{\text{Blow Energy}} = \frac{7.5}{W} \text{ to } \frac{15}{W}$$

where W is expressed in tonnes.

This gives wide ranging orders of magnitude depending on weight. For minus 200 mm Hematite (primary crusher undersize), the ratio is 250–500 times. For 1 metre cubed primary crusher feed, the ratio is 2–4 times.

Determining the relationship between single blow energy levels and resonance energy levels for breaking rock is obviously impossible—breaking rock using resonance has not yet been achieved. However, using scientific laboratory test results on other materials, the likely magnitude of the resonant of off resonant (single blow) ratio can be established.

Laboratory testwork on metal plates, indicates that power levels at resonance to achieve a given deflection are between 7 and 50 times less than the off resonant single blow power. Published pile driving information comparing single blow piles with resonant piles, indicates that speed increases between 30 and 130 times have been achieved. Using these results, it can be assumed that the ratio of non-resonant (single blow) to resonant energy is likely to be in the range of 10 to 100.

Combining the two ranges indicates that energy requirements at resonance for −200 mm hematite may be 20 to 50,000 times less than energy levels required for crushing. Table 1 reproduced below.

Testwork on rock types have been restricted to Hematite, B.I.F. (Banded Iron Formation) and Shale. Rock sizes have varied from 10 cm cubes up to 25 cubic metre boulders. This testwork has indicated a rough correlation between primary resonant frequencies and volume where:

$$F = \frac{k}{\sqrt[3]{V}}$$

$F$ = Hz (cycles/sec)
$V$ = Volume ($M^3$)

Additional testwork has indicated that resonant frequencies of rocks larger than 200 mm cubed (primary crusher undersize) are less than 4,000 $H_z$. Rocks over 0.5 $m^3$ (a cube with 0.8 m sides) have frequencies under 1,000. These two figures are important.

Firstly, a mechanical device currently exists which can deliver accurate pulsed energy of 11 kW up to 1,000 cycles/second. In theory, this machine can break rocks up to 15 tonnes using resonance, by delivering in 5 seconds, more that the calculated crushing energy at 30 Joules/kg.

Below 0.5 $m^3$ sizes (i.e., freqencies above 1,000 cycles/sec.), the frequency is such that electronic devices are required to control the accuracy of energy pulses. Lasers are an obvious choice. Pulsing lasers up to 25,000 Hz are commercially available and a 55 watt (average power) unit while only able to deliver sufficient power to theoretically break a minus 100 mm rock, this rock size goes up to 200 mm using a resonance "leverage" factor of 10, to 270 mm using 30; to 470 mm using 100 and to 1 metre using 1,000.

The attached energy and power tables compare four different sources, Impact Breakers (Rammer), High Pressure Pulsing Pumps, .22 Calibre Bullets and a 55 watt Pulsing Laser. This odd assortment of power sources is chosen for the following reasons: The Rammer 2000 breaks all Hematite and B.I.F. rocks; the Rammer 1600 breaks most of them. It is believed to be possible to accurately generate controlled pressure pulses in a water jet. Reliable high pressure pumps are available and as the calculations show, high speed water "slugs" look very powerful. A 2000 round-a-minute (33 Hz) .22 calibre rifle is commercially available. The rifle is more destructive then it should be according to its manufacturers. It "carves up" bullet proof vests whick easily stop single heavier calibre bullets. Calculations involving a single round, nevertheless, shown the projectile as a powerful energy source. The bullet has a very brief impulse time. Laser calculations refer to a 55 watt (average power) laser.

The colum "Peak Power" is a laser terminology. It is a calculation of the energy delivered by one pulse, over the time of that pulse, then multiplied up as if that power was delivered continually over 1 second.

Of particular interest in the first two tables are the following: The Rammer 1600 is more "powerful" than the Rammer 2000, but it delivers less energy per blow and less energy per blow per unit area. Energy delivered per unit area is physically limited by the strength of breaker tools. High pressure pumps are capable of delivering high energy levels per unit area. The apparently low powered laser (55 watts) can deliver a heavy punch per unit area when the beam is focused down to ½ mm and below (similar to stilleto heeled shoes).

TABLE 1

ENERGY REQUIREMENT
CRUSHING ENERGY c.w. RESONANT ENERGY

| Hematite/ B.I.F. Cube Dimension (m) | Crushing Energy @ (kJ) | Density 3.5 t/m³ Energy Requirement Reduced A Factor of 10 (J) | 30 | 100 | 500 | 1000 (J) | 3000 |
|---|---|---|---|---|---|---|---|
| 0.2 | .42 | 42 | 14 | 4.2 | .84 | .4 | .15 |
| 0.27 | 1.05 | 105 | 35 | 10.5 | 2.1 | 1.1 | .35 |
| 0.37 | 2.62 | 262 | 87 | 26.2 | 5.2 | 2.6 | .88 |
| 0.47 | 5.25 | 525 | 175 | 52.5 | 10.5 | 5.3 | 1.7 |
| 0.53 | 7.87 | 787 | 262 | 79 | 15.7 | 7.9 | 2.6 |
| 0.58 | 12.25 | 1225 | 408 | 123 | 24.5 | 12.2 | 4 |
| 0.67 | 15.7 | 1575 | 525 | 158 | 31.5 | 15.8 | 5 |
| 0.795 | 26.25 | 2625 | 875 | 263 | 52.5 | 26.2 | 9 |
| 1 | 52.5 | 5250 | 1750 | 525 | 105 | 52 | 17 |
| 1.145 | 78.7 | 7870 | 2620 | 787 | 158 | 79 | 26 |
| 1.26 | 105 | 10500 | 3500 | 1050 | 210 | 105 | 35 |
| 1.355 | 131 | 13100 | 4370 | 1310 | 262 | 131 | 44 |
| 1.44 | 157 | 15700 | 5230 | 1570 | 315 | 157 | 52 |
| 1.59 | 210 | 21000 | 7000 | 2100 | 420 | 210 | 70 |
| 2.15 | 525 | 52500 | 17500 | 5250 | 1050 | 525 | 175 |

Dashed area is within 55 W power range.

TABLE 2

ENERGY INPUT

| | Per Blow (Joules) | Per Sq Cm per Blow (Joules) |
|---|---|---|
| Rammer 2000 | 8200 | 35.5 |
| Rammer 1600 | 6010 | 30.3 |
| High Pressure Pump | | |
| 15,000 psi: f = 35 Hz | 270 | 1280 |
| 10,000 psi: f = 750 Hz | 3.2 | 45 |
| .22 calibre bullet | 11.5 | 40 |

| Laser | | Focus 0.5 mm | 0.25 mm |
|---|---|---|---|
| f = 10,000 Hz | .005 | 3 | 11 |

TABLE 2-continued

ENERGY INPUT

| | | | |
|---|---|---|---|
| f = 5,000 Hz | .011 | 5 | 22 |
| f = 1,000 Hz | .055 | 27 | 110 |

TABLE 3

POWER INPUT

| | Peak Power kW | Peak Power Per Sq Cm kW |
|---|---|---|
| Rammer 2000 | | |
| Impulse Time (sec) | | |
| 0.01 | 820 | 3.5 |
| 0.004 | 2050 | 8.9 |
| 0.002 | 4090 | 17.8 |
| Rammer 1600 | | |
| Impulse Time (sec) | | |
| 0.01 | 840 | 4.2 |
| 0.004 | 2100 | 10.6 |
| 0.002 | 4200 | 21.2 |
| High Pressure Pump | | |
| 15,000 psi: f = 35 Hz | 37.8 | 178 |
| 10,000 psi: f = 750 Hz | 9.6 | 135 |
| .22 calibre bullet | 410 | 1450 |

| Laser | | Focus 0.5 mm | 0.25 mm |
|---|---|---|---|
| f = 10,000 Hz | | | |
| f = 5,000 Hz | 40 | $20 \times 10^3$ | $80 \times 10^3$ |
| f = 1,000 Hz | | | |

BRIEF DESCRIPTION OF THE DRAWINGS

These and other objects, advantages and novel features of the invention will become apparent from the detailed description of the best mode for carrying out the preferred embodiment of the drawings which follows, particularly when considered in conjunction with the accompanying drawings, wherein.

BEST MODE FOR CARRYING OUT THE INVENTION

Figure 1:
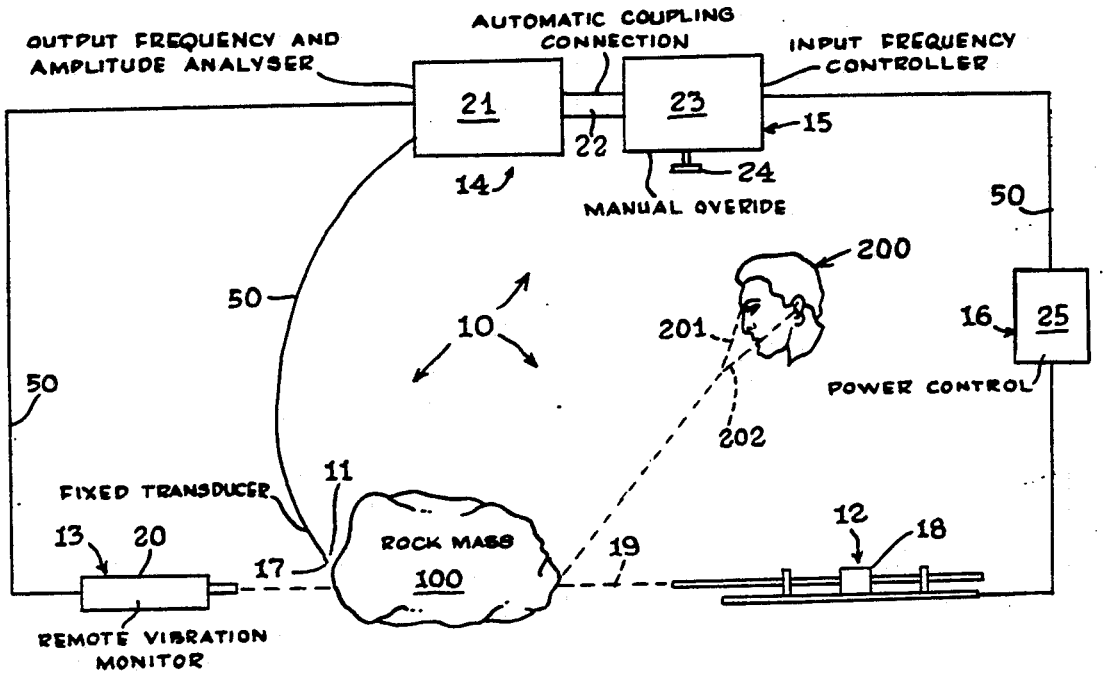
FIG. 1 is a schematic view of the apparatus that is used to carry out the method of this invention.
Figure 2:
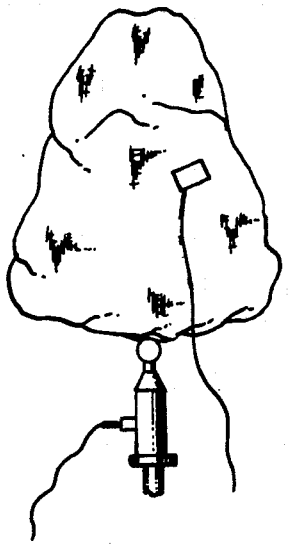
FIG. 2 is a schematic view of a mechanical energy input device and a fixed transducer.
Figure 3:
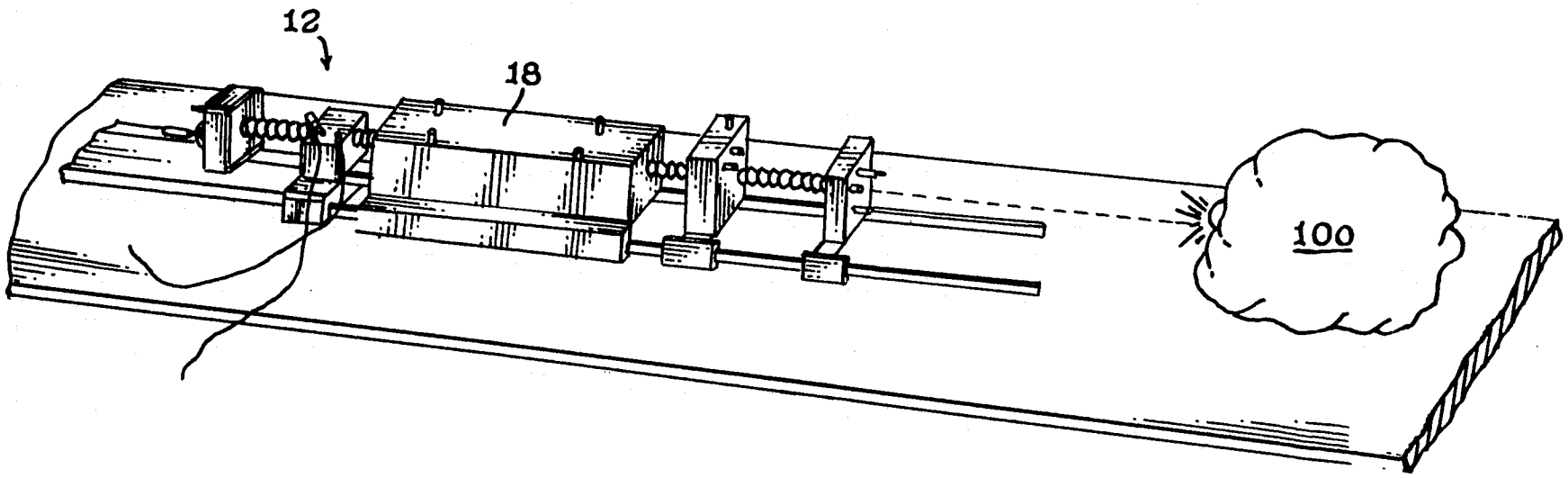
FIG. 3 is an isolated view of the preferred energy pulsing member of this invention.

As can be seen by reference to the drawings, and in particular to FIG. 1, the apparatus that is employed in this invention is designated generally by reference numeral (10). The apparatus (10) comprises in general a transducer unit (11), an energy generating unit (12), a vibration monitor unit (13), an analyser unit (14), a frequency control unit (15), and a power control unit (16), which are used to fracture a rock mass (100). These units will now be described in seriatim fashion.

As can best be seen by reference to FIG. 1, the transducer unit (11) comprises a fixed acoustic transducer member (17) that is operatively associated with the rock mass (100) to sense the vibration of the rock mass (100) over a small portion of the surface area of the mass (100).

The energy generating unit (12) of the preferred embodiment comprises a low powered pulsing laser member (18) wherein the power requirements of the laser member (18) is approximately equal to 55 watts and, the laser beam (19) is focused down to ½ mm or less.

The vibration monitor unit (13) comprises a remote vibration monitor member (20) such as the 55x Laser Doppler Vibrometer System manufactured by DISA Electronik of Denmark, wherein the output of the remote vibration monitor member (20) is transmitted by an electrical lead (50) to analyzer unit (14). Either the vibration monitor unit (13) is used in the circuit or the fixed transducer unit (11).

The analyzer unit (14) comprises an output frequency and amplitude analyzer member (21) which is connected by electrical leads (50) to either the remote vibration monitor member (20) or the fixed transducer member (17) to measure the frequency and amplitude of vibration of the rock mass (100). In addition, the frequency and amplitude analyzer member (21) is operatively coupled as at (22) to the frequency control unit (15).

The frequency control unit (15) comprises an input frequency controller member (23) having a manual override (24), wherein the input frequency controller member (23) is attached by electrical leads to a power control unit (16) in the form of a conventional power control member (25) and thence to the energy generator unit (12).

In the operation of the apparatus (10), the operator (200) would either employ the manual override (24) to vary the output of the frequency controller member (23) relative to the energy generator unit (12) until such time that visual (201) or audio (202) indications, such as sparks or cracking sounds were detected from the rock mass (100), or the output from the fixed transducer member (17) or the remote vibration monitor member (20) are used to automatically determine a change in the resonant frequency of the rock mass (100) and the input frequency controller member (23) then adjusts the output of the energy generator unit (12) to match the new resonant frequency of the rock mass (100) to continue the fracturing process.

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An apparatus for fracturing a mass of material such as rock, using resonant frequencies wherein, the apparatus comprises:

means for determining the resonant frequency for a given mass of material:

non-contacting sub-ultrasonic frequency generating means for generating frequencies in the sub-ultrasonic range;

means for monitoring changes in the resonant frequency of the mass of material as fracturing takes place;

energy generating means; and, control means operatively associated with the means for monitoring or the non-contacting frequency generating means for varying the output of the energy generating means in response to the input of the means for monitoring changes in the resonant frequency of the mass such that fracturing of the mass of material will continue.

2. The apparatus as in claim 1 wherein the non-contacting energy generating means comprises a laser.

3. The apparatus as in claim 2 wherein the means for monitoring changes in the resonant frequency of the mass of material as fracturing takes place includes a remote vibration monitor and a transducer operatively associated with the said mass of material.

4. The apparatus as in claim 3 wherein the control means comprises an output frequency and amplitude analyzer operatively coupled to an input frequency controller, wherein the output frequency and amplitude analyzer is responsive to the output from the remote vibration monitor or the transducer operatively associated with the mass of material and, wherein the input frequency controller varies the frequency of the non-contacting energy generating means.

* * * * *